US010287095B2

(12) United States Patent
Reeb et al.

(10) Patent No.: US 10,287,095 B2
(45) Date of Patent: May 14, 2019

(54) LOCKING DEVICE FOR WASTE CONTAINER

(71) Applicant: SERIO-US INDUSTRIES, INC., Baltimore, MD (US)

(72) Inventors: David L. Reeb, Sykesville, MD (US); James L. Martin, II, Gambrills, MD (US)

(73) Assignee: Serio-Us Industries, Inc., Baltimore, MD (US)

( * ) Notice: Subject to any disclaimer, the term of this patent is extended or adjusted under 35 U.S.C. 154(b) by 370 days.

(21) Appl. No.: 15/395,579

(22) Filed: Dec. 30, 2016

(65) Prior Publication Data

US 2017/0190509 A1 Jul. 6, 2017

Related U.S. Application Data

(60) Provisional application No. 62/273,649, filed on Dec. 31, 2015.

(51) Int. Cl.

| | |
|---|---|
| ***B65F 1/16*** | (2006.01) |
| ***B65F 1/12*** | (2006.01) |
| ***E05B 17/20*** | (2006.01) |
| ***E05B 65/52*** | (2006.01) |
| ***E05B 67/38*** | (2006.01) |
| ***E05C 19/00*** | (2006.01) |

(52) U.S. Cl.

CPC ..... *B65F 1/1615* (2013.01); *B65F 1/122* (2013.01); *B65F 1/1646* (2013.01); *E05B 17/2011* (2013.01); *E05B 65/5246* (2013.01); *E05B 67/383* (2013.01); *E05C 19/003* (2013.01); *B65F 2210/148* (2013.01)

(58) Field of Classification Search

CPC ..... B65F 2001/1669; Y10T 292/1063; Y10T 292/0937; Y10T 292/1006; E05B 15/0093; E05B 65/5292; Y10S 292/04

USPC ..... 292/130, 183, 230

See application file for complete search history.

(56) References Cited

U.S. PATENT DOCUMENTS

| | | | |
|---|---|---|---|
| 4,844,113 | A | 7/1989 | Jones |
| 5,094,358 | A | 3/1992 | Serio, Sr. |

(Continued)

OTHER PUBLICATIONS

Corresponding ISR for PCT/US2016/035667.

*Primary Examiner* — Shawn M Braden

(74) *Attorney, Agent, or Firm* — Berenato & White, LLC

(57) ABSTRACT

The invention relates to locking devices, more particularly, gravity actuated locking devices, e.g., for waste containers. The locking device is designed to be fixed to a container and contains a gravity operated locking mechanism and a locking unit that couples the gravity operated locking mechanism to a locking bar. The locking bar allows the lid of the container to be blocked or opened depending upon the relative position of the locking bar to the lid. In the blocked position, the locking bar sits over the lid and does not allow it to be opened. In the opened position, the locking bar is removed from the lid and allows the lid to be opened. When in the container is in the upright position, the parts of the locking device cooperate to block the locking bar from being moved from the blocked position. However, when the container is tilted forward, e.g. for emptying the content of the container, gravity, acting on the parts of the locking device, allows the locking bar to be moved to the opened position.

20 Claims, 13 Drawing Sheets

(56) References Cited

U.S. PATENT DOCUMENTS

| | | | | | |
|---|---|---|---|---|---|
| 5,149,153 | A | | 9/1992 | Drewry et al. | |
| 5,152,562 | A | | 10/1992 | Stevenson et al. | |
| 5,201,434 | A | | 4/1993 | De Vivo et al. | |
| 5,213,382 | A | | 5/1993 | Dawdy et al. | |
| 5,217,267 | A | * | 6/1993 | Yagi | E05C 17/085 217/60 F |
| 5,224,743 | A | | 7/1993 | Dawdy et al. | |
| 5,224,744 | A | | 7/1993 | Michelutti | |
| 5,388,876 | A | | 2/1995 | Saincome | |
| 5,415,314 | A | | 5/1995 | McCollum | |
| 5,419,598 | A | | 5/1995 | Kreitzer | |
| 5,474,341 | A | | 12/1995 | Putman et al. | |
| 5,490,606 | A | | 2/1996 | Lombardo | |
| 5,599,050 | A | | 2/1997 | Tinsley | |
| 5,662,364 | A | * | 9/1997 | Reeb | B65F 1/1615 292/230 |
| 5,683,126 | A | | 11/1997 | De Vivo et al. | |
| 5,697,655 | A | | 12/1997 | Strong | |
| 5,738,395 | A | | 4/1998 | Evan | |
| 5,997,052 | A | * | 12/1999 | Reeb | B65F 1/1615 292/148 |
| 6,290,093 | B1 | | 9/2001 | Obriot et al. | |
| 6,382,688 | B1 | | 5/2002 | Agostini | |
| 6,550,827 | B1 | | 4/2003 | Tsujino | |
| 6,666,485 | B1 | * | 12/2003 | Moret | B65F 1/1615 220/315 |
| 6,733,053 | B2 | | 5/2004 | Hodge et al. | |
| 6,802,550 | B1 | | 10/2004 | Griggs, Jr. et al. | |
| 6,808,080 | B2 | | 10/2004 | Spiers et al. | |
| 6,851,288 | B2 | | 2/2005 | Howes | |
| 7,234,327 | B2 | | 6/2007 | Howes | |
| 7,506,902 | B2 | | 3/2009 | Sheng et al. | |
| 7,806,447 | B2 | * | 10/2010 | Reeb | B65F 1/1615 220/315 |
| 8,313,126 | B2 | * | 11/2012 | Ferkovich | B65F 1/1615 292/11 |
| 8,550,282 | B1 | | 10/2013 | Libhart | |
| 8,960,735 | B2 | | 2/2015 | Michael | |
| 2009/0066092 | A1 | | 3/2009 | Reeb | |
| 2009/0091141 | A1 | * | 4/2009 | Kreitzer | B65F 1/1615 292/130 |
| 2010/0102575 | A1 | | 4/2010 | Ferkovich et al. | |
| 2016/0355334 | A1 | * | 12/2016 | Reeb | E05B 63/0052 |

* cited by examiner

LOCKING DEVICE FOR WASTE CONTAINER

CROSS-REFERENCE TO RELATED APPLICATIONS AND CLAIM TO PRIORITY

This application claims the priority of U.S. Provisional Patent Application No. 67/273,649, filed Dec. 31, 2015, the disclosure of which is incorporated herein by reference

FIELD OF THE INVENTION

The present invention generally relates to locking devices, particularly for waste containers. In particular, the invention relates to waste container locking devices that are actuated by gravity.

BACKGROUND

As is well known, waste containers, such as refuse dumpsters for use in residential and industrial applications, typically include a container supported on a base structure. With the advent of mechanized trash removal, there have been created a number of large sized trash bins or dumpster containers. These containers usually comprise a block-shaped or pyramid-shaped container with a hinged lid attached to one side thereof. The container further includes attachments for accommodating various forked lifting mechanisms of the trash removal vehicle. The containers are lifted by the lifting mechanism of the trash removal vehicle and pivoted in some fashion so that the hinged top of the container opens and the trash contained therein is emptied into the vehicle. The container is then returned to a position on the ground, and the hinged lid closes on top of the container. Frequently these large trash receptacles are rented from a trash removal service. These receptacles are not provided free of charge, and consequently their frequent emptying and service can become a considerable expense. This expense is increased when unauthorized users of the receptacle freely deposit trash therein. This unauthorized use necessitates a more frequent emptying of the container, and of course the unauthorized user does not contribute to offset the increased expense.

In order to reduce the added expense that comes from unauthorized use, the dumpsters frequently are locked. While conventional chains and padlocks reduce unauthorized dumpster use, they also add to operating expenses because the driver of the truck emptying the dumpster must get out of the truck to unlock the padlock on the dumpster. In the early 1990's, companies began the development and marketing of dumpster locking mechanisms that opened automatically when the dumpster was lifted and inverted to dump the trash into the truck. With such an automatic lock, the driver is not required to leave the truck which saves the trash company hundreds of dollars each year.

Conventional automatic locks may be bulky, expensive and difficult to mount to multiple containers. Since containers come in a variety of shapes and sizes, it is important that the locking device be sized and shaped to be retrofit onto a variety of existing containers. Moreover, the locking device must be able to withstand the rigors of everyday, outdoor use in the waste environment.

Therefore, there exists a need for an automatic locking device that improves upon prior automatic locking devices and solves the problems inherent in known automatic locking devices.

SUMMARY OF THE INVENTION

The present invention relates to a gravity actuated locking device for a waste container, preferably a waste dumpster. The container has a hinged lid that is movable between an upright storing position and a tilted dumping position for emptying the container. The locking device allows the lid of the container, when the container is in an upright position, to be locked to prevent unauthorized access to the container. When the container is tilted from the upright position, e.g. to empty the contents of the container, the locking device allows the lid to open.

The locking device is designed to be fixed to the container and contains a gravity operated locking mechanism and a locking unit that couples the gravity operated locking mechanism to a locking bar. The locking bar allows the lid of the container to be blocked or opened depending upon the relative position of the locking bar to the lid. In the blocked position, the locking bar sits over the lid and does not allow it to be opened. In the opened position, the locking bar is removed from blocking the lid and allows the lid to be opened. The gravity operated locking mechanism is housed inside a base unit that is adapted to be fixed to the container. The gravity operated locking mechanism contains a pair of stop members, a sliding platform sandwiched and slidable between the pair of stop members, a rolling member disposed within a slanted slot in the sliding platform, a spring member biasing the sliding platform toward a blocked position, and a cam member which is rotatable to bias the sliding platform in an opened position opposing the blocked position. When the container is in the upright position, the rolling member, due to its position in the slanted slot, and the stop members cooperate to block the sliding platform from being moved against the force of the spring member. However, when the container is tilted forward, e.g. for emptying the contents of the container, the rolling member is pulled by gravity to an opened position in the slanted slot which releases the block on the sliding platform. In that opened position, the sliding platform can be pushed forward against the spring member by rotation of the cam member, which thereby allows the locking unit to rotate to release the lid of the container.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The foregoing background and summary, as well as the following detailed description of the drawings, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

(FIG. 7A shows the assembled locking device, while FIG. 7B shows the parts separated);

(FIG. 9A shows the view with the front stop member removed, while FIG. 9B shows the view with the front stop member in place); (FIG. 10A shows the view with the front stop member removed, while FIG. 10B shows the view with the front stop member in place).

DETAILED DESCRIPTION OF THE PREFERRED EMBODIMENT(S)

Figure 1:
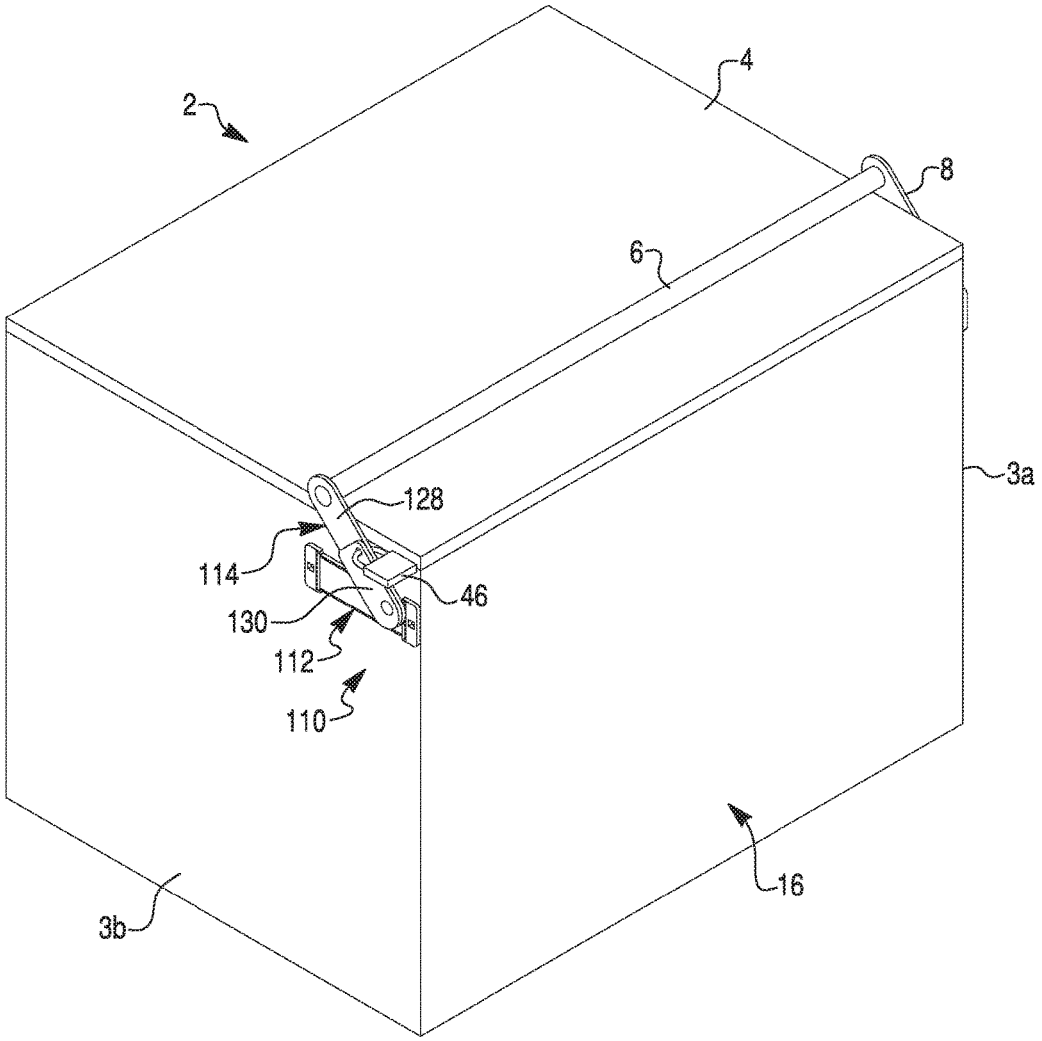
FIG. 1 is a perspective view of a waste container in an upright position with a locking device according to an exemplary embodiment of the present invention shown in a closed position.

The exemplary embodiment of the present invention will now be described with the reference to accompanying drawings. The following description of the preferred embodiment is merely exemplary in nature and is in no way intended to limit the invention, its application, or uses.

For purposes of the following description, certain terminology is used in the following description for convenience only and is not limiting. The characterizations of various components and orientations described herein as being "vertical", "horizontal", "upright", "right", "left", "side", "top", or "bottom" designate directions in the drawings to which reference is made and are relative characterizations only based upon the particular position or orientation of a given component as illustrated. These terms shall not be regarded as limiting the invention. The words "downward" and "upward" refer to position in a vertical direction relative to a geometric center of the apparatus of the present invention and designated parts thereof. The terminology includes the words above specifically mentioned, derivatives thereof and words of similar import. Additionally, the word "a" as used in the claims means "at least one."

Figure 2:
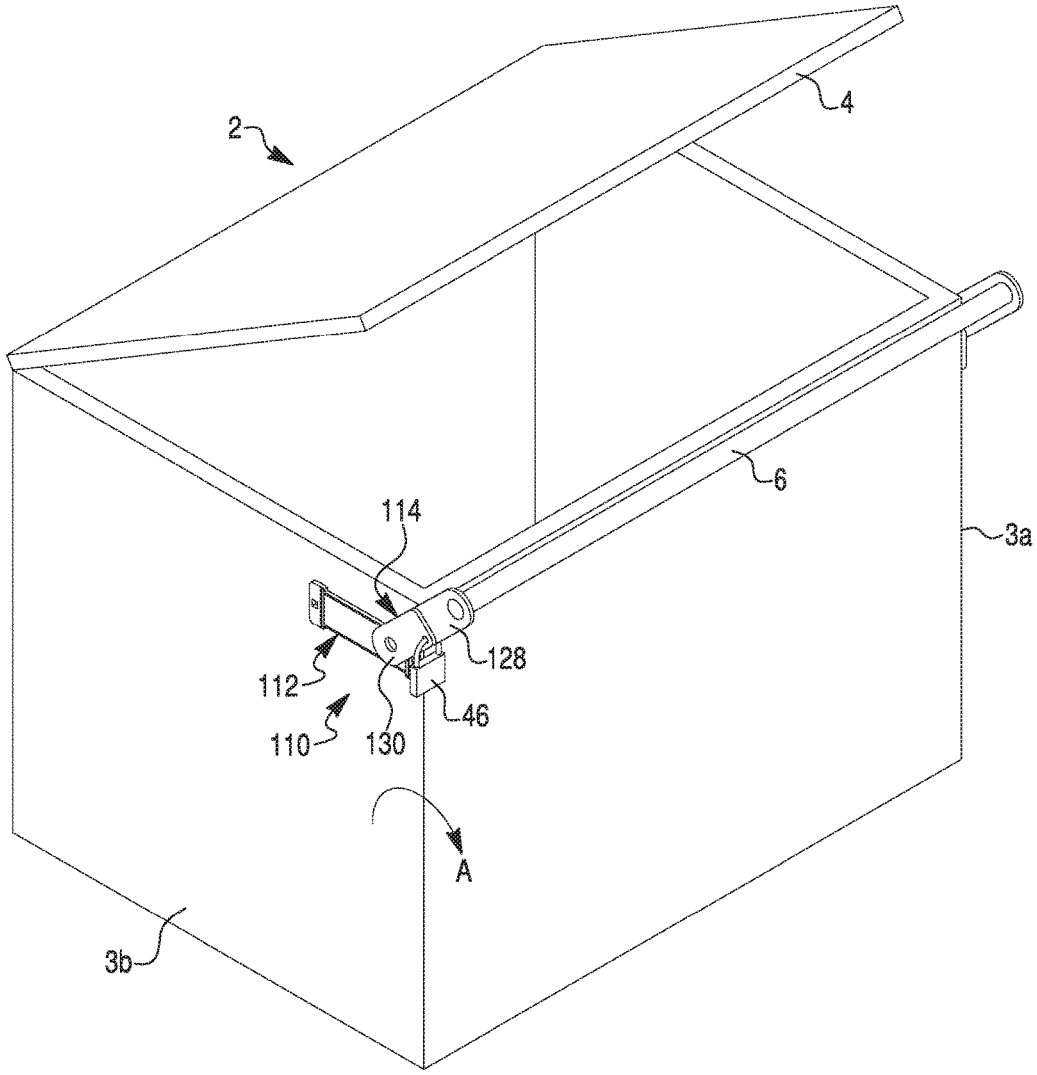
FIG. 2 is a perspective view of the waste container in a tilted position with the locking device according to the exemplary embodiment of the present invention shown in an open position.

FIGS. 1 and 2 illustrate a waste or storage container 2, such as a trash collector or dumpster. The container 2, as best illustrated in FIGS. 1 and 2, is preferably an industrial-type dumpster used for retaining, storing, and eventually disposing of refuse (waste), such as glass fragments produced during the manufacture of automotive glass and other industrial waste products. The container 2 may be tilted or otherwise pivoted from an upright storage position (wherein the waste container 2 is sitting generally horizontally) (shown in FIG. 1) to a tilted or dumping position (shown in FIG. 2).

Figure 5:
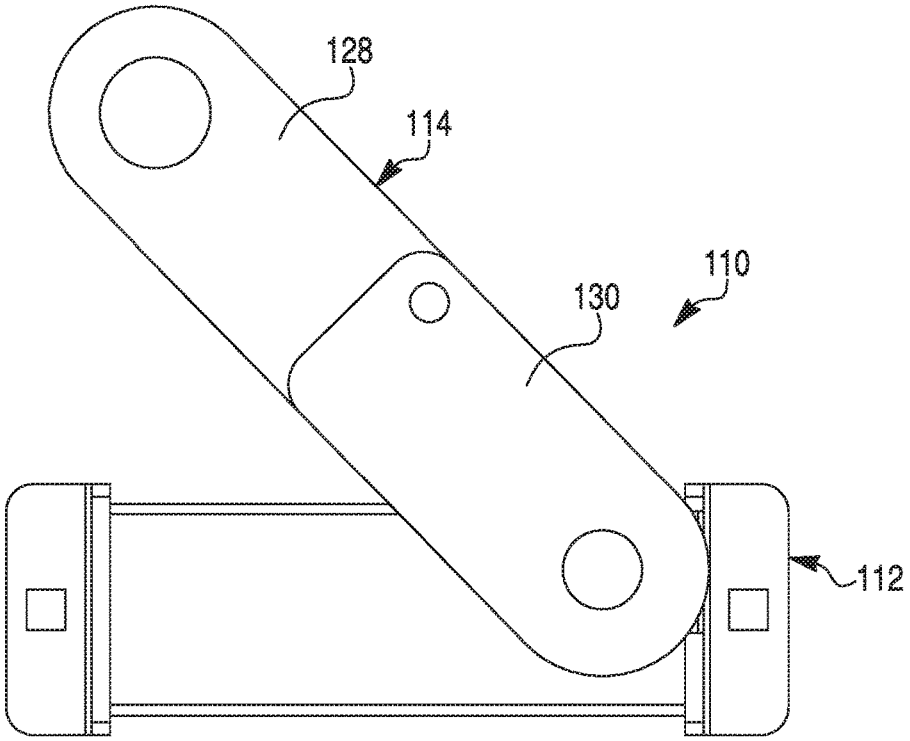
FIG. 5 is a side elevational view of the locking device according to the exemplary embodiment of the present invention shown in the closed position.

The container 2 has at least one hinged lid 4 on top of a main box 16, a safety locking device 110 according to an exemplary embodiment of the present invention, and a locking bar 6 extending across the width of the container 2 (FIGS. 1 and 2). The locking device 110 is provided for locking and unlocking the waste container 2 to prevent the inadvertent dumping of its contents or to authorized opening of the lid 4. The locking bar 6 extends between a pivotable unit 128, as best shown in FIG. 5, of the safety locking device 110 at one end and a pivoting bar 8 at the other end thereof, as best shown in FIG. 1. The pivotable unit 128 is part of the safety locking device 110 which is mounted to a side wall 3*b* of the container 2, such as the left side wall as shown in FIG. 5, while the pivoting bar 8 is pivotally fixed to a side wall 3*a* (opposing and approximately parallel to the left side wall 3*b*) of the container 2. When the locking bar 6 is located over the lid 4, it blocks the lid 4 and prevents lid 4 from being opened. When locking bar 6 is rotated forward during dumping of container 2, toward to the front of the container 2 and away from the lid 4, the lid 4 can be opened to allow for emptying or filling of the container 2. Rotation of the locking bar 6 away from the lid 4 can be effected by pulling on the locking bar 6 to allow the pivoting bar 8 and pivotable unit 128 to pivot at their respective attachments to the side walls 3*a*, 3*b*, thereby allowing the locking bar 6 to move away from the lid 4 of the container 2. The pivotable unit 128 is part of the safety locking device 110 and is pivotally coupled to the base unit 112. When a padlock 46 or the like is used to couple the pivotable unit 128 to the rest of flhe locking device 110, the first pivotable unit 128 cannot pivot and locks locking bar 6 in place. However, when the lock 46 is removed, the pivotable unit 128 pivots freely and the locking bar 6 can be moved to allow the lid 4 to be opened.

Even when the lock 46 is in place, the safety locking device 110 is a gravity-actuated device that allows the kicking bar 6 to be moved to allow for the lid 4 to open, such as when the container 2 is tilted to the dumping position (FIG. 2). When the container 2 is in its upright position of FIG. 1 and when the lock 46 is in place, the locking device 110 prevents opening of the lid 4 by keeping the locking bar 6 in place. To open the lid 4, a user must first remove the lock 46 to uncouple the pivotable unit 128 from the rest of the locking device 110, then pull the locking bar 6 forward to unblock the lid 4. Unauthorized use of the container 2 is thus prevented, while allowing for emptying of the container 2 by tilting it, e.g., into a trash truck.

Figure 3:
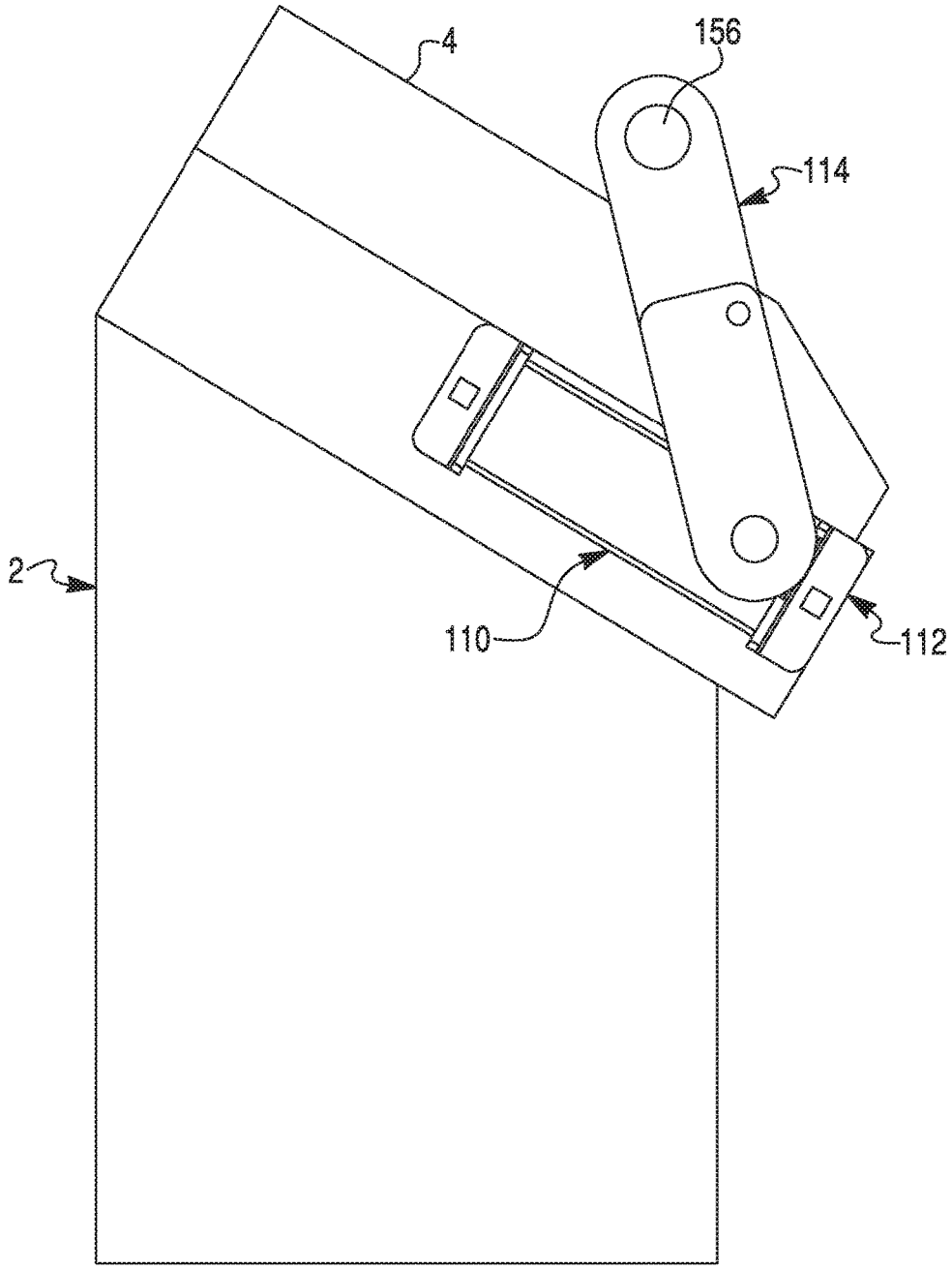
FIG. 3 is a side elevational view of a waste container in an upright position with a locking device according to the exemplary embodiment of the present invention shown in a closed position.
Figure 4:
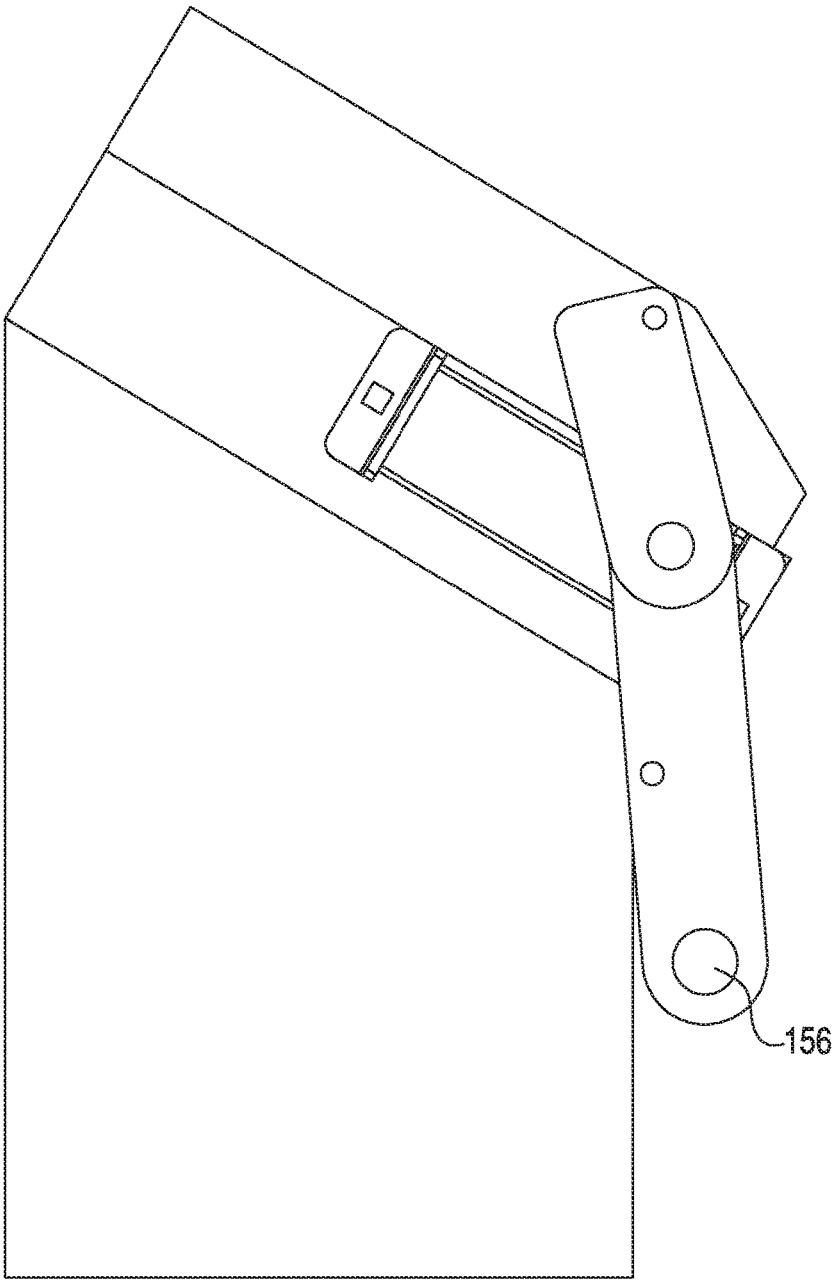
FIG. 4 is a side view of the waste container of FIG. 3 in an upright position with the locking device according to the exemplary embodiment of the present invention, shown without the padlock and with a pivotable unit separated from a fixed unit.
Figure 6:
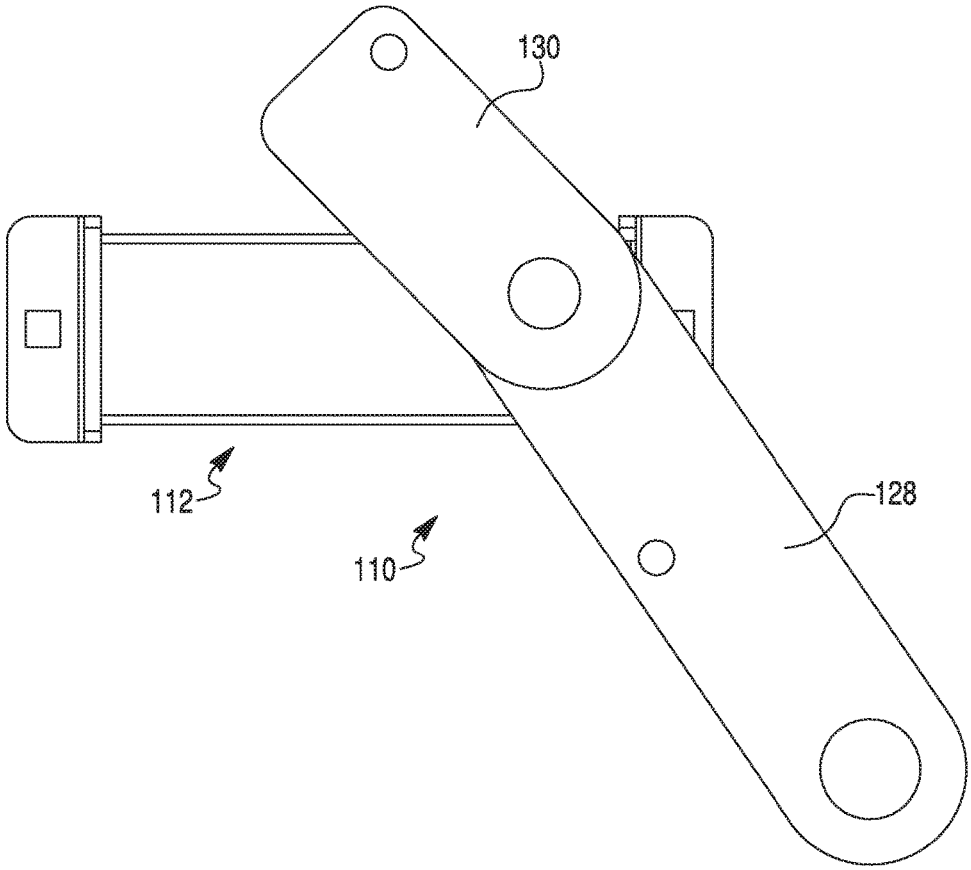
FIG. 6 is a side elevational view of the locking device of FIG. 5 shown without the padlock and with the pivotable unit separated from the rest of the locking device.
Figure 7A:
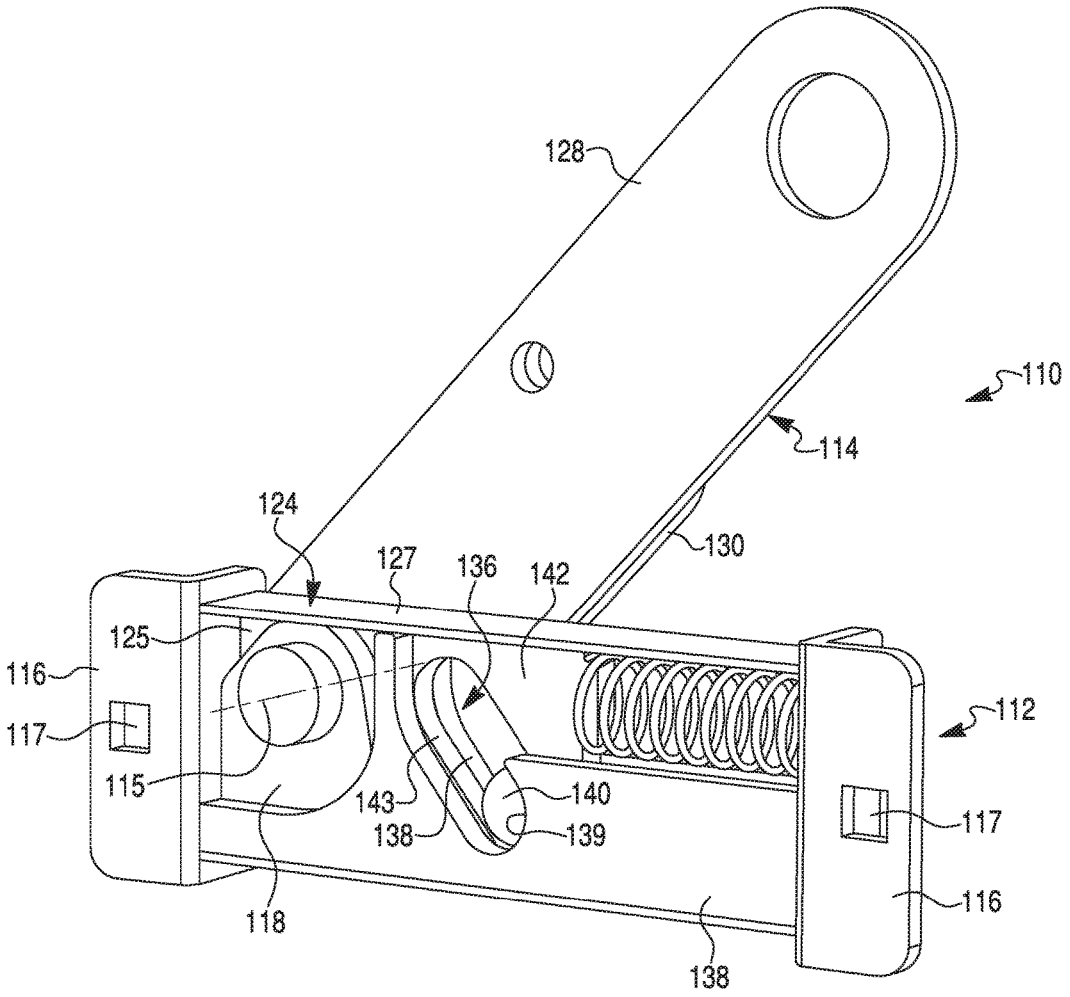
FIGS. 7A and 7B show a perspective view and an assembly view, respectively, of the locking device according to the exemplary embodiment of the present invention in a blocking position, without a base plate and the outer plate
Figure 7B:
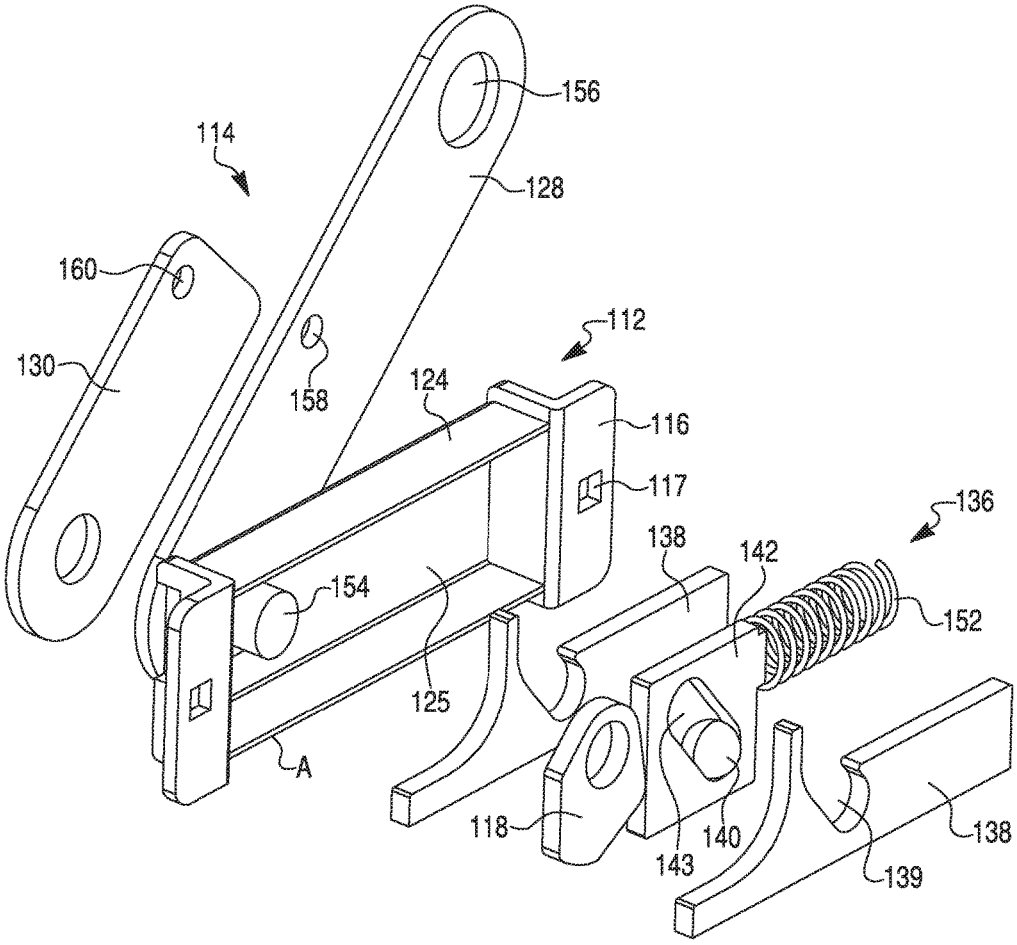
Figure 8:
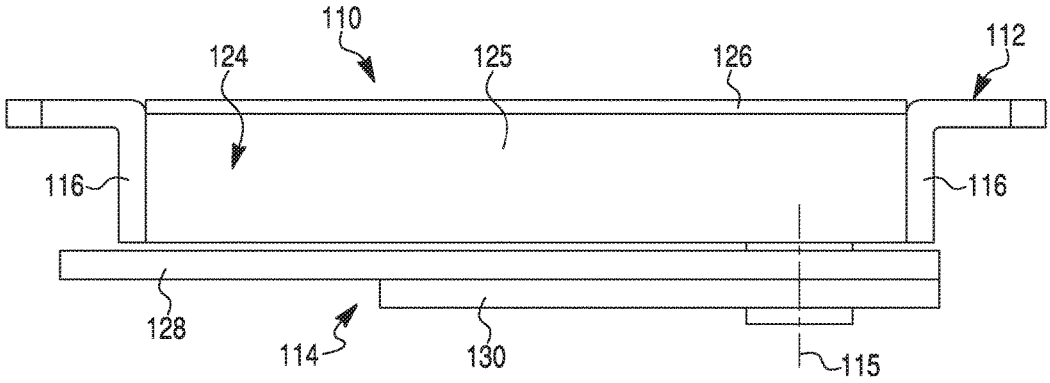
FIG. 8 is a top view of the locking device according to the exemplary embodiment of the present invention in the blocked position.

FIGS. 3-10 illustrate an exemplary embodiment of a safety locking device for a waste or storage container 2, generally depicted by the reference character 110. The locking device 110 according to an exemplary embodiment of the present invention, as illustrated in detail in FIGS. 3-6, comprises a base unit (housing) 112 to be fixed to the left side wall 3*b* of the waste container 2, and an elongated pivotable unit 128 pivotally mounted to the base unit 112 for pivotable movement relative to the base unit 112 about a pivot axis 115 as best shown in FIGS. 7-8. The locking bar 6 is secured to the pivotable unit 128 at a distal end thereof so as to extend across the length of the waste container 2, as best illustrated in FIGS. 1-2. The pivotable unit 128, the pivoting bar 8 and the locking bar 6 movable therewith are able to translate from a closed position of the waste container 2 wherein the locking bar 6 extends over the hinged lid 4 of the waste container 2 so as to prevent opening of the waste container 2, as illustrated in FIGS. 3 and 5, and an open position of the waste container 2 wherein the locking bar 6 is horizontally spaced away from the hinged lid 4 of the waste container 2 so as to allow the opening of the hinged lid 4 of the waste container 2, as illustrated in FIGS. 4 and 6.

The base unit 112, as illustrated in detail in FIGS. 7-8, comprises a base member 124 having a U-shaped cross-section (as best shown in FIG. 7B) and defining an open, elongated, channel-like cavity 125, a base plate 126 (shown in FIG. 8) non-movably attached to a bottom of the base member 124, such as by welding, in order to cover the cavity 125, and two oppositely disposed L-shaped mounting members 116 fixed to the base member 124 at longitudinally opposite ends thereof, such as by welding. The oppositely disposed mounting members 116 delimit the cavity 125 within the base unit 112. Each of the mounting members 116 has a through-hole 117 therethrough. Accordingly, the base unit 112 may be fastened to the left side wall 3*b* of the waste container 2 by threaded fasteners (not shown in detail extending through holes 117 in the mounting members 116. The base plate 126, as best shown in FIG. 8, is adjacent to the left side wall 3*b* of the waste container 2 when the locking device 110 is mounted to the waste container 2.

The base unit 112 further comprises a pivoting, gravity operated locking mechanism 136 disposed in the cavity 125 of the base member 124. The locking mechanism 136 comprises a pair of stop members 138 disposed in the cavity 125 of the base member 124 and extending between the mounting members 116, a sliding platform 142 movable within the cavity 125 between an opened and a blocked positions ("opened position" refers to the position of the locking device 110 that allows the lid 4 to open; "blocked position" refers to the position of the locking device 110 that allows the lid 4 to be blocked by the locking bar 6), a rolling member 140 disposed within the cavity 125 of the base member 124 and moveable under gravity relative to the stop members 138 and the sliding platform 142, a spring member 152 biasing the sliding platform 142 toward the blocked position, and a cam member 118. The sliding platform 142 is sandwiched between the stop members 138 and is reciprocatingly and slidingly movable within the cavity 125 relative to the stop members 138 between the opposite mounting members 116 and substantially perpendicular to the pivot axis 115. The sliding platform 142 has an angularly disposed slot 143 for receiving the rolling member 140. The slot 143 is preferably angled at about 30 to 60° relative to the sliding direction (toward and away from the spring member 152) of the sliding platform 142. The stop members 138 are immobile structurally, and geometrically identical, and are shaped such that when the rolling member 140 is in the blocked position (as described below), the stop members 138 prevent the rolling member 140 (and thus the sliding platform 142) from sliding against the spring member 152. The shape of the stop members 138 allows rolling member 140 (and thus the sliding platform 142) to slide against the spring member 152, when the roiling member 140 is in the opened position.

Figure 9A:
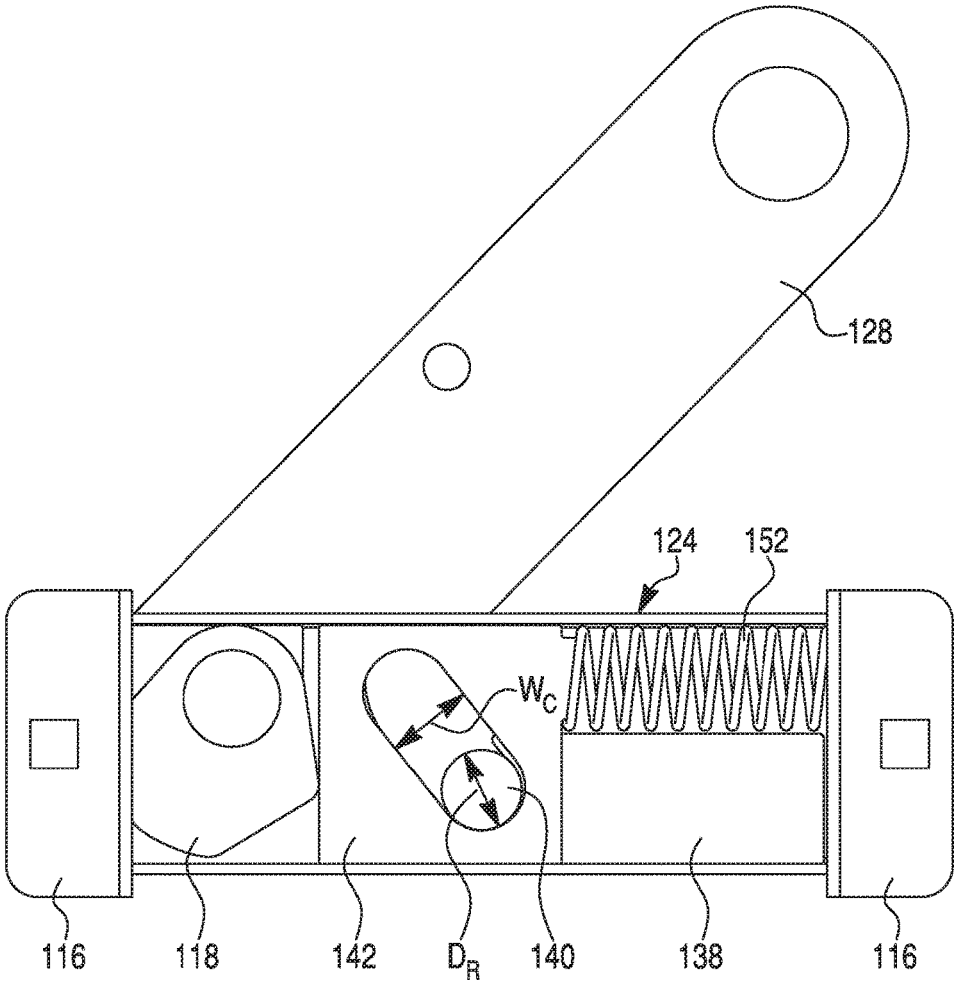
FIGS. 9A and 9B show side views of the of the locking device according to the exemplary embodiment of the present invention in the blocked position
Figure 10A:
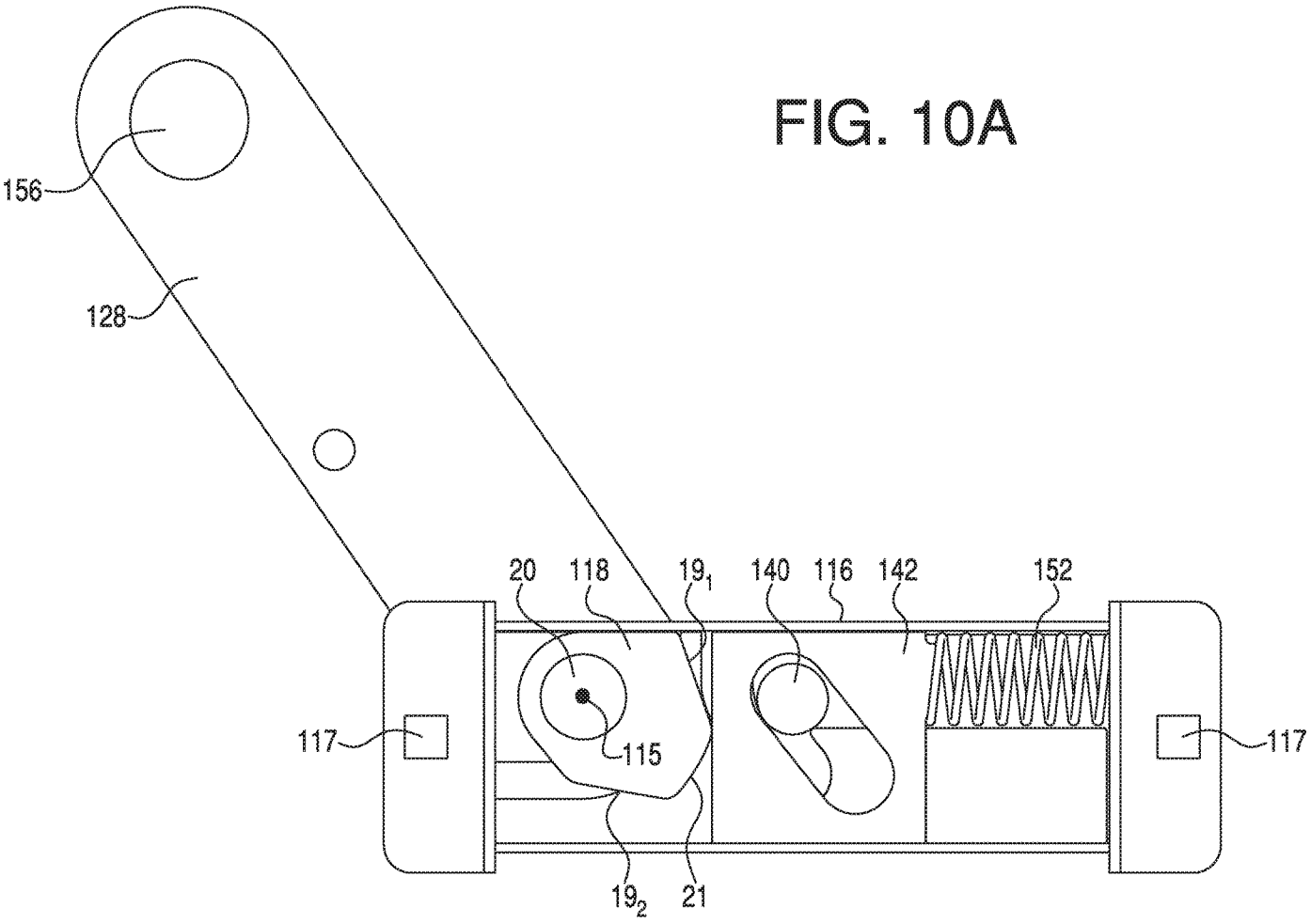
FIGS. 10A and 10B show side views of the locking device according to the exemplary embodiment of the present invention in the opened position

As best illustrated in FIGS. 7A and 7B, the rolling member 140 may be in the form of a spherical ball. Alternatively, the rolling member 140 may be in the form of a cylindrical disc, capable of rolling within slot 143. It will be appreciated that a diameter $D_R$ of the roiling member 140 is the same or slightly smaller than a width $W_C$ of the slot 143 (as best shown in FIGS. 9A and 10A), such that the rolling member 140 can roll freely within the slot 143. When the container 2 is in an upright position, the rolling member 140 is pulled by gravity into a blocked position. When the container 2 is in a tilted position the rolling member 140 is pulled by gravity into an opened position. The position of the rolling member 140 controls operation of the gravity actuated locking mechanism as described below.

As further illustrated in FIGS. 7-10, each of the stop members 138 has a notch 139, which overlaps (registers with) the slot 143 in the sliding platform 142. A width $W_{SC}$ of the notch 139 in the stop members 138 is approximately the same as the width $W_C$ of the slot 143 in the sliding platform 142. The notch 139 partially overlaps the perimeter of the slot 143 in the sliding platform 142 in the blocked position thereof (as shown in FIGS. 9A and 9B), and only partially overlaps the slot 143 in the sliding platform 142 in the opened position thereof (as shown in FIGS. 10A and 10B). In the blocked position, the rolling member 140 is located at a first end of the slot 143 and lodged in the notches 139 of the stop members 138 and blocks the sliding platform 142 from sliding against the spring member 152. In the opened position, the rolling member 140 is located at a second end of the slot 143 and free of the notches 139 to allow the sliding platform 142 to slide toward the spring member 152, when the cam member 118 is rotated. It is important that the notches 139 be configured such that when the rolling member 140 is located at the second end of the slot 143, the stop members 138 do not impede the sliding platform 142 from sliding toward the spring member 152.

The cam member 118 is located within the cavity 125 and abuts the sliding platform 142 at an edge opposing the spring member 152. As best shown in FIG. 10A, the cam member 118 is approximates a tear-drop-shaped plate whose perimeter includes a first support surface $\mathbf{19}_1$ and a second support surface $\mathbf{19}_2$ forming a cam lobe 21 therebetween. The cam member 118 also contains a hole 20 in the middle for connecting it with the locking unit 114 via a shaft 154, best shown in FIG. 7B. The hole 20 has a center axis 115. The distance between the axis 115 and the cam lobe 21 is greater than the distance between the axis 115 and either support surface $\mathbf{19}_1$ or $\mathbf{19}_2$. The cam member 118 is also partially sandwiched between the stop members 138.

The cam member 118 is connected to the locking unit 114 via the shaft 154. The locking unit 114 contains a pivotable unit 128 and a fixed unit 130. The fixed unit 130 is preferably an elongated member having one end non-rotatably connected to the cam member 118, such that it can only be rotated with the cam member 118. On the other hand, the pivotable unit 128 is also an elongated member having one portion rotatably connected to the cam member 118, such that it can be rotated around axis 115 independently of the cam member 118. The pivotable unit 128 may have a hole slightly larger than the shaft 154 such that the shaft 154 passes through the hole while allowing for rotation of the pivotable unit 128 around the shaft 154. The fixed unit 130, on the other hand, is fixed to the shaft 154, e.g. by press fitting or welding. The shaft 154 is also fixed to the cam member 118, e.g. by press fitting or welding, such that the fixed unit 130 and the cam member 118 are non-rotatably connected via the shaft 154. The other end of the pivotable unit 128 is attached to the locking bar 6, preferably through a hole 156. The pivotable unit 128 and fixed unit 130 also containing locking holes 158 and 160, respectively. The locking holes 158, 160 are aligned so that lock 46 can be inserted through the holes 158, 160 to couple the locking bar 6 to the locking device 110.

The locking device 110 is mounted to a side wall 3*b* of the container 2 in a position such that when the container 2 is in an upright position, the rolling menther 140 is in the blocked position. Preferably, when the container 2 is in its upright position, the locking device may be mounted in a substantially horizontal position, where the pivotable unit 128 and the fixed unit 130 point upwardly and toward the rear of the container 2, and the spring member 152 is located to the rear of the sliding platform 142 which, in turn, is to the rear of the cam member 118. In this position, if a lock 46 is not holding the pivotable unit 128 and the fixed unit 130 together, the locking bar 6 may be pulled forward to allow the lid 4 to be opened. However, when the lock 46 holds pivotable unit 128 and the fixed unit 130 together, the locking bar cannot be pulled forward.

Figure 9B:
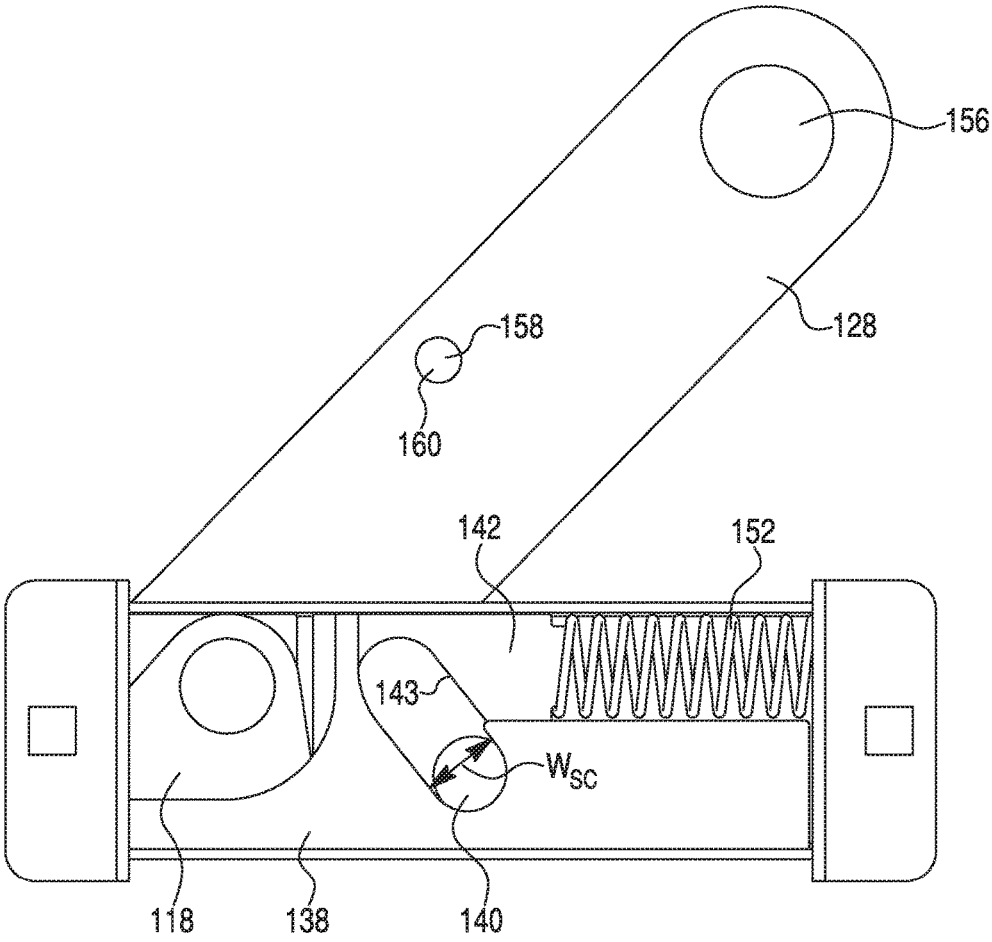

When the container 2 is in its upright position, as best shown in FIG. 1, the locking device 110 is in the blocked position, which, when the pivotable unit 128 is locked to the fixed unit 130 by the lock 46, prevents the locking bar 6 from being moved. The blocked position is best depicted in FIGS. 9A and 9B. In the blocked position, gravity pulls the rolling member 140 to the bottom of the slot 143. When in that position, the rolling member 143 lodges in the notches 139 of the stop members 138 and prevents the sliding platform 142 from sliding toward and compressing the spring member 152. As such, the fixed unit 130 cannot be pulled forward to release the lid 4.

Figure 10B:
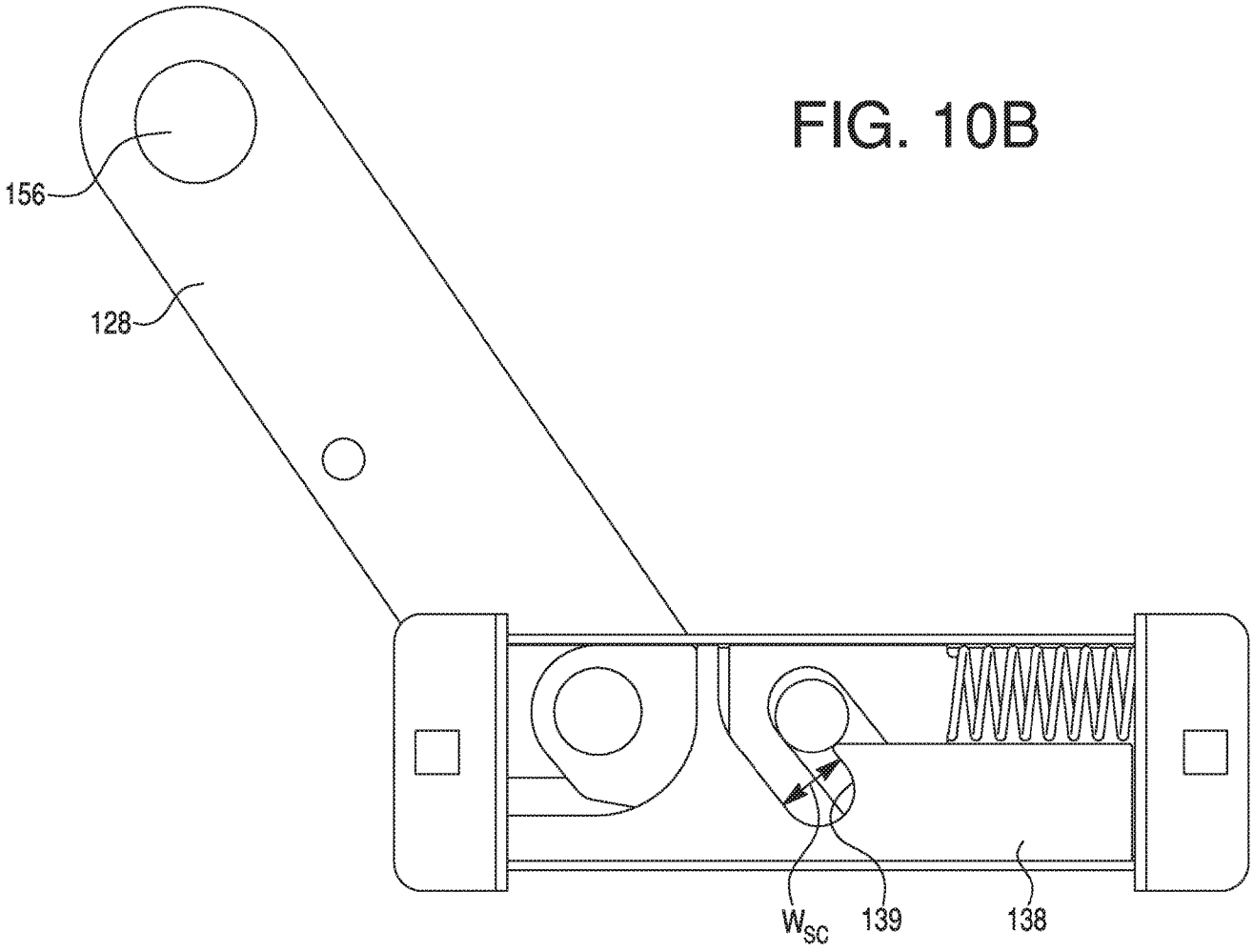

When the container 2 is in its tilted position, as best shown in FIG. 2, the locking device 110 is in the opened position, which, even when the pivotable unit 128 is locked to the fixed unit 130 by the lock 46, allows the locking bar 6 to be moved forward to release the lid 4. The opened position is best depicted in FIGS. 10A and 10B. In that position, gravity pulls the rolling member 140 to the top of the slanted slot 143. The rolling member is thus no longer lodged in the notches 139 and jammed by the stop members 138, which allows the sliding platform 142 to be moved toward the spring member 152. As a result, the locking bar 6 can be moved forwardly, which also rotates the fixed unit 130 (when it is locked to the pivotable unit 128). The pivoting of the fixed unit 130 rotates the cam member 118 around axis 115 to allow the cam lobe 21 to push the sliding platform 142 against and compresses the spring member 152. Thus, the movement of the rolling member 140 in the tilted position releases the locking mechanism to allow the lid 4 to be opened.

When the container 2 is placed back into its upright position, the spring member pushes the sliding platform 142 back into its blocked position; and gravity pulls the rolling member 140 to the bottom of the slanted slot 143 to lock the sliding platform 142 in the blocked position.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A gravity actuated locking device, comprising:

a) a pair of spaced apart stop members;

b) a sliding platform sandwiched and slidable between the stop members, the sliding platform including an angularly disposed slot;

c) a rolling member disposed within the slot;

d) a spring member biasing the sliding platform towards a blocked position;

e) a rotatable cam member sandwiched between the sliding platforms and biasing the sliding platform in an opened position opposing the blocked position; and f) a locking unit connected to the cam member.

2. The device of claim 1, further comprising a base member having an internal cavity housing components a) to e), the base member comprises fore and aft ends enclosed by mounting members for mounting the device on a container, and a hole; a shaft fixed to the cam and protrudes through the hole to connect the locking unit to the cam member.

3. The device of claim 2, Wherein the stop members are immovably fixed in the cavity between the mounting members.

4. The device of claim 3, wherein the sliding platform is moveable and has a sliding direction between the mounting members.

5. The device of claim 4, wherein the slot is angled at about 30 to about 60° relative to the sliding direction of the sliding member.

6. The device of claim 2, wherein the cam member is located at the aft end of the base member, the spring member has a first end abutting the sliding platform and a second end abutting the mounting member enclosing the fore end of the base member to bias the sliding platform toward the cam member.

7. The device of claim 1, wherein the rolling member is a ball or a cylindrical disk.

8. The device of claim 1, wherein the locking unit comprises a pivotable unit rotatably connected to the cam member via a shaft, and a fixed unit non-rotatably connected to the cam member via the shaft.

9. The device of claim 8, wherein the shaft is fixed to the cam member, the pivotable unit comprises an elongated plate having a first end rotatably connecting to the shaft and a second end configured to connect to a locking bar, and the fixed unit comprises an elongated plate having an end non-rotatably connecting to the shaft.

10. The device of claim 8, wherein the pivotable unit is located between the fixed unit and the cam.

11. The device of claim 1, wherein the rotatable cam member comprises a plate whose perimeter includes a first support surface and a second support surface forming a cam lobe therebetween, when the cam is in a blocked position, the first support surface abuts the sliding platform and when the cam is in an opened position, the cam lobe abuts the sliding platform to bias the platform against the spring member.

12. The device of claim 11, wherein the cam further comprises a hole, a shaft is fixed in the hole and connects the cam to the locking unit.

13. The device of claim 12, wherein the distance between a center of the hole and the cam lobe is greater than the distance between the center of the hole and either the first support surface of the second support surface.

14. The device of claim 1, wherein the sliding platform is located between the cam member and the spring, and the spring biases the sliding platform toward the cam member.

15. The device of claim 14, wherein each of the stop members comprises a plate having a notch therein that overlaps the slot at a lower end of the slot.

16. The device of claim 15, wherein the blocked position is achieved by the rolling member being located at the lower end of the slot and lodged in the notches of the stop members to prevent the sliding platform from sliding toward the spring, and the opened position is achieved by the rolling member being located at an upper end of the slot and free of the notches to allow the sliding platform to slide toward the spring.

17. The device of claim 1, wherein the rolling member spans the thicknesses of the stop members and the sliding platform.

18. A waste container, comprising:

a) a main box;

b) a lid hingedly connected to and located on top of the main box;

c) a locking bar extending substantially across the width of the main box and having a first end and a second end;

d) the gravity actuated locking device of claim 1 located on a first wall of the main box and connected to the first end of the locking bar; and e) a pivoting bar mounting to a second wall of the main box opposing the first wall and connected to the second end of the locking bar.

19. The container of claim 18, wherein the container is a waste dumpster.

20. The container of claim 18, wherein the locking unit comprises a pivotable unit having a first end rotatably connected to the cam member via a shaft and a second end connecting to the locking bar, and a fixed unit non-rotatably connected to the cam member via the shaft.

* * * * *